United States Patent [19]

Bisbing

[11] Patent Number: 4,880,261

[45] Date of Patent: Nov. 14, 1989

[54] REMOTE LATCH MECHANISM

[75] Inventor: Robert H. Bisbing, Springfield, Pa.

[73] Assignee: Southco, Inc., Concordville, Pa.

[21] Appl. No.: 149,571

[22] Filed: Jan. 28, 1988

[51] Int. Cl.[4] ..... E05C 9/08

[52] U.S. Cl. ..... 292/7; 292/66; 292/DIG. 31; 292/DIG. 60

[58] Field of Search ..... 292/5, 6, 7, 47, 48, 292/66, 111, 113, 218, DIG. 31, DIG. 49, DIG. 60, DIG. 71

[56] References Cited

U.S. PATENT DOCUMENTS

| | | | |
|---|---|---|---|
| 133,370 | 11/1872 | Jennings | 292/202 X |
| 810,340 | 1/1906 | Meis | 411/403 X |
| 1,883,804 | 10/1932 | Marqué | 292/111 |
| 1,919,328 | 7/1933 | Hansen | 292/218 |
| 2,592,647 | 4/1952 | Black | 292/218 |
| 3,045,465 | 7/1962 | Larson | 292/DIG. 71 X |
| 3,844,591 | 10/1974 | Velcover | 292/7 |
| 4,134,281 | 1/1979 | Pelcin | 292/DIG. 31 X |
| 4,230,351 | 10/1980 | Bisbing | 292/DIG. 49 X |
| 4,632,438 | 12/1986 | McKinney | 292/DIG. 60 X |
| 4,693,503 | 9/1987 | Bisbing | 292/DIG. 31 X |

*Primary Examiner*—Richard E. Moore

*Attorney, Agent, or Firm*—Paul & Paul

[57] ABSTRACT

A remote latching mechanism is provided having a connecting member, preferably a cylindrical rod, means for rotating the connecting member about its longitudinal axis, and a latch assembly connected to the connecting member for movement between latched and unlatched conditions in response to the rotation of the connecting member. The means for rotating the rod may be a handle assembly, having a handle journalled within a handle cup, and/or a socket member affixed to the end of the rod for rotation of the rod upon application of torque of the socket member. The latch assembly comprises a crank, at least one link member having over-center action, a pawl support and a pawl, all interconnected so that upon rotation of the crank, the pawl is pivoted and slid relative to a latch housing between latched and unlatched positions.

38 Claims, 2 Drawing Sheets

REMOTE LATCH MECHANISM

BACKGROUND OF THE INVENTION

This invention relates to the field of latching mechanisms, and more particularly to the field of remote latching mechanisms. A remote latching mechanism, as the term is used herein, is a latching mechanism in which the latching action of the mechanism occurs at a location remote from the latch actuator part of the mechanism. Most particularly, the present invention relates to a remote latch and the latch actuator occurs by means of a bar or rod.

Many types of remote latching mechanisms are known and used in the art. One of the most common types is the garage door mechanism located inside the garage door, wherein a centrally located latch actuator assembly, which usually consists of a handle protruding from the outside of the door and connected by an axle to the mechanism on the inside of the door, is connected in an offset fashion to one end of a pair of latching bars with each bar traversing the inside of the garage door horizontally and in opposite directions. The other end of each of the latching bars terminates just short of the inside edge of the respective sides of the garage door, where it is usually retained in a keeper, when the latching mechanism is in an open position.

To latch the mechanism, the handle is rotated which causes the latching bars or rods to extend laterally into a detent or cutout provided on a frame which usually is located on the inside of the garage wall and next to each of the respective sides of the garage door. Another type of remote latch mechanism is disclosed in co-pending U.S. patent application Ser. No. 100,623, filed Sept. 24, 1987, which disclosure is incorporated herein by reference. As is discussed in fuller detail in the aboverefe-renced application, distinction can be made between compression type remote latching mechanisms, and non-compression type remote latching mechanisms, with the compression type remote latching mechanism typically providing greater security and precision in the latched position.

SUMMARY OF THE INVENTION

The present invention is directed towards a remote latching mechanism which provides a high degree of precision and security, whether used as a compression type remote latching mechanism or, alternatively, used as a non-compression type remote latching system. The remote latching mechanism is particularly suited for use in securing closure members to a frame, such as cabinets or like structures.

The present invention comprises an actuation assembly or a handle assembly, with a connecting means, preferably a bar or rod, connected to at least one latch assembly. The handle assembly comprises essentially a cup adapted to be affixed within an aperture in a door or the like and a handle pivotally mounted to the cup for actuation from the outside of the door. The connecting means is preferably a continuous longitudinal rod which is disposed vertically on the inside of the door. The connecting means is affixed to the handle for rotational movement in response to the pivoting movement of the handle.

The latch assembly comprises a housing adapted to be affixed to the inside of the door, a crank, a pair of link members connected to the crank, a pawl support member connected to the links, and a pawl affixed to the support member. The crank is in operable engagement with the connecting rod, whereby upon rotation of the rod, the pawl is pivoted and slid between latched and unlatched positions. The link members, forming the operative connection between the crank and the pawl, comprise over-center members to provide positive latching action.

It is a feature of the present invention that the handle assembly actuates the latch assembly through the rotation of the connecting means about its longitudinal axis. In the preferred embodiments, this feature allows for the use of a continuous rod as the connecting means for a plurality of latch assemblies operable by actuation of a single handle assembly. It should be noted, however, that a non-continuous rod or other type of connecting means rather than a continuous connecting means could be used without departing from the scope of the present invention.

Accordingly, it is an object of the present invention to provide a remote latching mechanism that can be used as either a compression or non-compression remote latching mechanism.

It is a further object of the present invention to provide a remote latch mechanism wherein the latch assembly is actuated through an elongate connecting means which rotates about its longitudinal axis.

It is a further object of the present invention to provide a remote latching mechanism whereby a plurality of latch assemblies may depend from a connecting rod and is actuated by a single actuating means.

It is still another object of the invention to provide a remote latching mechanism having positive over-center latching action.

It is yet another object of the invention to provide a remote latching mechanism which is economical to manufacture and easy to install.

It is a further object of this invention to provide a secure remote latching mechanism which has an aesthetically pleasing appearance when viewed from the outside.

It is yet another object of the invention to accomplish the above objects by providing a remote latching mechanism having a longitudinal connecting means, actuating means for rotating the connecting means about its longitudinal axis, and at least one latch mechanism operably engaged with the connecting means for actuation of a latching pawl in response to rotational movement of the connecting means.

These and other objects of the invention will become apparent to one skilled in the art upon a further reading of the specification, including the detailed description of the embodiments with reference to the drawings and the appended claims.

DETAILED DESCRIPTION OF THE PREFERRED EMBODIMENTS

Figure 1:
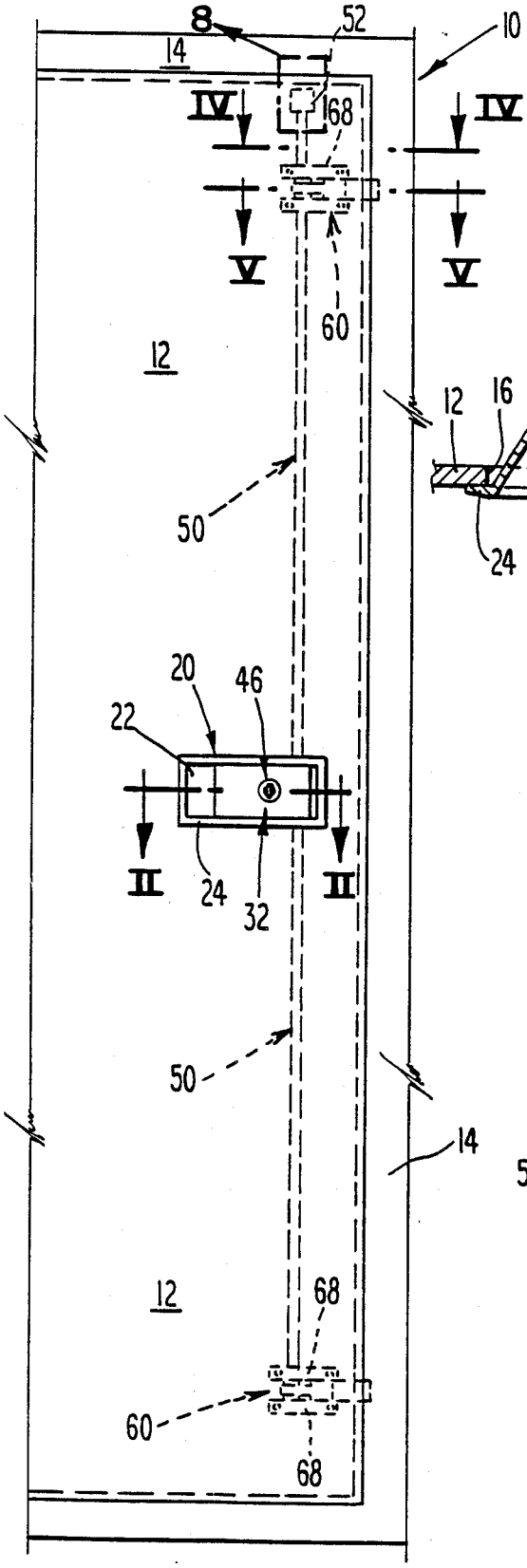
FIG. 1 is a front elevational view of one embodiment of the present invention, as applied to a cabinet or the like, comprising a handle assembly, connecting rod, and two latch assemblies.

With reference first being made to FIG. 1, one embodiment of the remote latching mechanism in accordance with the present invention is illustrated therein installed on a typical cabinet structure 10, having an openable door 12 and a stationary frame 14. In the particular embodiment shown in FIG. 1, the remote latching mechanism comprises a handle assembly 20, a single continuous connecting rod 50 connected to handle assembly 20 and vertically disposed on the inside of door 12, and two latch assemblies 60 connected to the connecting rod at spaced locations along the rod 50 from the handle assembly 20. In the view shown in FIG. 1, handle assembly 20 is in the closed position and latch assemblies 50 are in the latched position, whereby the door 12 is securely retained against frame 14.

Figure 2:
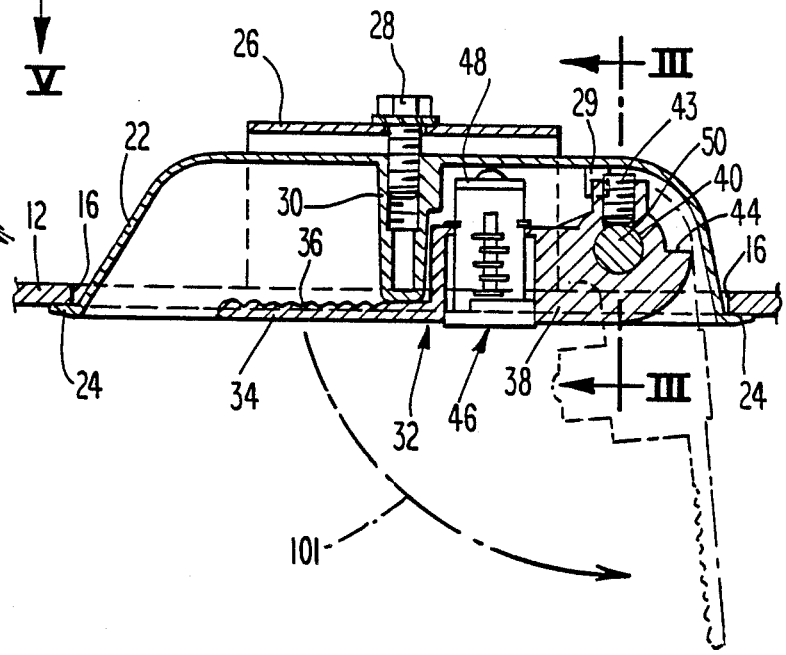
FIG. 2 is a sectional view of the handle assembly along line II—II of FIG. 1, with the handle in an unlatched position being shown in phantom.
Figure 3:
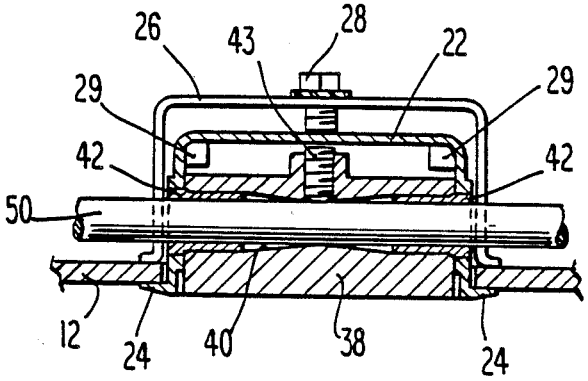
FIG. 3 is a sectional view of the handle assembly taken along line III—III of FIG. 2.

With reference now being made to FIGS. 1–3, handle assembly 20 comprises a bath-tub shaped cup member 22 having outwardly-turned edges to form a peripheral flange 24 on the outside of the cup 22. The cup 22 is adapted for being inserted within a suitable aperture 16 in door 12, whereby peripheral flange 24 is disposed substantially flush with the outer surface of door 12 (See FIGS. 2–3). Cup 22 is held within aperture 16 of door 12 by bracket 26 which, as seen in FIG. 3, is a substantially U-shaped member and is adapted to engage the inside surface of the door 12.

As seen in FIGS. 2 and 3, bracket 26 is secured to cup 22 by a screw 28 or other suitable fastener which traverses bracket 26 and is received within boss 30 of cup 22. In this arrangement, which is perhaps best seen in FIG. 3, door 12 is clamped between bracket 26 and peripheral flange 24 of cup 22, whereby cup 22 is securely held within aperture 16 of the door. In other words, door 12 is held in sandwich relation between bracket 26 and peripheral flange 24.

Pivotally connected to cup 22 of handle assembly 20 is handle 32 which, as seen in FIG. 2, is an irregular shaped member having a substantially flat section 34 which terminates at a location intermediate boss 30 of frame 22 and the end wall of cup 22, such that a space is created within cup 22 to accommodate the fingers of the user of the latch mechanism. To facilitate the pivoting of handle 32, the finger-engageable surface of flat section 34 may be provided with serrations 36, as seen in FIG. 2.

Adjacent flat section 34, handle 32 is provided with a substantially thickened section 38. Section 38 of handle 32 is pivotally connected to cup 22 for pivoting of handle 32 relative to the cup. Section 38 also forms the connection of handle 32 to connecting rod 50 for actuation of the latch assemblies 60, all of which will be described more fully below. As best seen in FIG. 3, section 38 of handle 32 is provided with a transverse bore 40 which has a venturi-like shape when viewed along its longitudinal axis. Disposed within bore 40 at the ends thereof are a pair of bushing members 42 which are secured within cup 22, whereby bushing members 42 comprise means for pivotally connecting handle 32 to cup 22.

Thickened section 38 is also provided with a peripheral abutment 44 which, when handle 32 is pivoted to its open position illustrated in fanthom in FIG. 2, abuts against stop members 29 of cup 22 (see FIG. 3) to limit the pivotal movement of handle 32.

If desired, handle 32 may also be provided with an integral locking means, such as lock cylinder 46, as shown in FIG. 2. Lock cylinder 46 is of known construction and operates in a known manner. To lock the handle 32 in position, a rotatable locking tab 48 is provided which, when lock cylinder 46 is actuated, will rotate to engage boss 30 to prevent the pivoting of handle 32 relative to cup 22 and thus, as explained below, the actuation of latching mechanisms 60.

Connecting rod 50, in the embodiment illustrated in the Figures, is a continuous, elongate rod having a circular cross-sectional shape. Although a connecting rod of such configuration is preferred for reasons of strength, economy of manufacture and ease of assembly, it is to be understood that polygonal rods or flat bars are also suitable, if desired. Furthermore, although the connecting rod 50 shown in the Figures comprises a single continuous member engaging handle assembly 20 and both latching assemblies 60, it is to be understood that other configurations may be used, if desired, so long as at connecting rod 50 engages at least one actuator assembly and at least one latching assembly.

With reference to FIGS. 2 and 3, connecting rod 50 is disposed within bore 40 of handle 32 and in close-fit relation to bushing members 42. Set screw 43 in thickened section 38 of handle 32 maintains the connecting rod 50 within bore 40, whereby connecting rod 50 rotates about its cross-sectional center in response to the pivoting of handle 32. As seen in FIG. 2, connecting rod 50 comprises the pivotal axis for the pivoting of handle 32 relative to cup 22.

Figure 8:
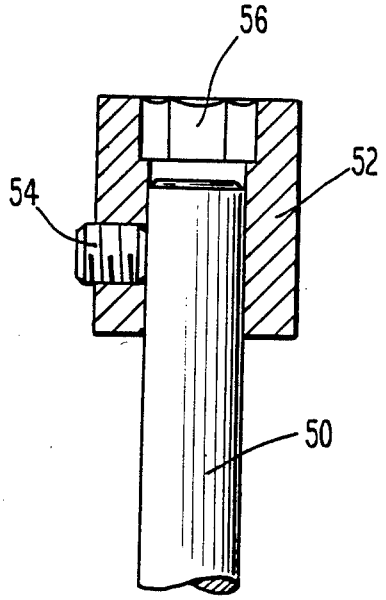
FIG. 8 is an enlarged sectional view of an alternate actuation means for actuating the latch assemblies of FIG. 1, which may be used in lieu of or in addition to the handle assembly.

An alternative means for rotating connecting rod 50 is shown in FIG. 8 and comprises a socket member 52 which is adapted to fit over a terminal end of rod 50. Socket member 52 is also provided with a set screw 54 which engages rod 50 whereby rod 50 is rotatably movable in response to the application of torque to socket member 52. As seen in FIG. 8, socket member 52 is provided with a suitably shaped recess 56 therein which is adapted to receive a suitably shaped tool, such as a hex key, for the application of torque to the socket member. Socket member 52 is entirely optional, in accordance with the desires of the user of the present invention, and may be used in lieu of or in addition to the handle assembly 20 as means for actuating latch assemblies 60. If socket member 52 is used, a suitable access will need to be provided in the cabinet 10 or other structure to which the invention is applied.

With reference now being made to FIGS. 4–7, the latch assembly 60 of the present invention will now be described. Latch assembly 60, as seen in the Figures, comprises a housing 62 having spaced-apart side walls 64 and a top wall 66. The lower edges of side walls 64 are turned outwardly to form mounting flanges 68 (see FIG. 1) which flanges 68 comprise means for facilitating the mounting of housing 62 to the inside surface of door 12, such as by screws 70 or like fastening means.

Disposed within housing 62 between spaced-apart side walls 64 is a crank member 72 which, as seen in the Figures, is provided with an aperture 74 therein into which is disposed sleeve 76. As seen in the Figures, sleeve 76 is adapted to receive connecting rod 50 therein in close fit relation and sleeve 76 is also in close-fit relation to crank 72. Crank 72 is also provided with a set screw 78 which is positioned to engage sleeve 76 and connecting rod 50. In this arrangement, crank 72 rotates within housing 62 in response to rotational movement of connecting rod 50. (See FIGS. 5 and 5A.) Aperture 63 in top wall 66 of housing 62 facilitates the loosening and tightening of set screw 78.

A pair of link members 80 are affixed to crank 72 by transverse pin 82. Link members 80, as seen in the Figures, are substantially "hourglass" or "figure-eight" shaped members and are movable in response to rotation of crank 72. As will be described more fully below, link members 80 comprise over-center members during operation of latch assembly 60.

Pivotally connected to link members 80 by transverse pin 84 is a pawl support 86. As seen in the Figures, pawl support 86 is substantially triangular in shape and is provided with a transverse guide pin 88, the significance of which is described below. The right-hand edge (as viewed in the Figures) of pawl support 86 is provided with at least one, and preferably two tapped apertures 90, and is also preferably provided with small serrations 92 on the surface thereof. (See FIGS. 4 and 6.) Tapped apertures 90 facilitate the connection of pawl 94 to pawl support 86, such as by screw 96, or like fastener.

Figure 4:
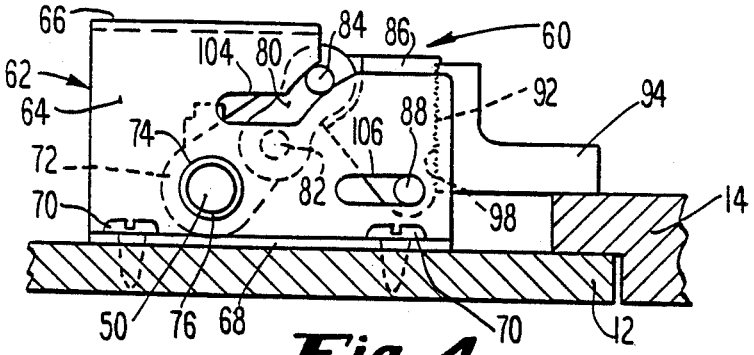
FIG. 4 is an elevational, partly sectioned, view of the latch assembly taken along line IV—IV of FIG. 1.
Figure 5:
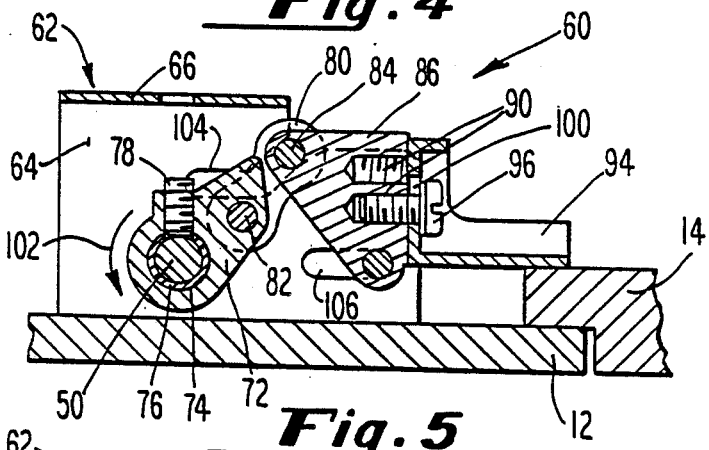
FIG. 5 is a sectional view of the latch assembly as seen along line V—V of FIG. 1, showing the latch assembly in a latched position.
Figure 7:
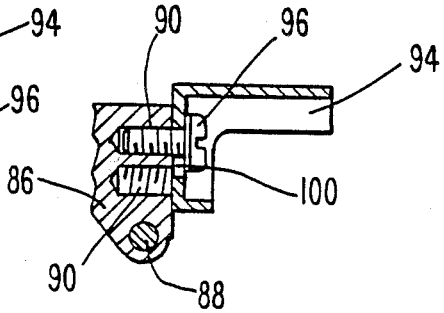
FIG. 7 is a sectional view of the pawl and pawl support, similar to FIG. 6, with the orientation of the pawl being reversed to accommodate for greater door and frame dimensions.

Pawl 94, as seen in FIGS. 4, 5 and 7, is a substantially L-shaped member having a short leg affixed to the pawl support 86 whereby the long leg of pawl 94 extends beyond housing 62. To facilitate the adjustability of pawl 94 so as to accommodate for variable door and frame dimensions and for different compression loads (such as when a gasket is employed between the door and frame of the structure), serrations 98 are provided on the short leg of pawl 94. Serrations 98 mate with serrations 92 of pawl support 86 (see FIG. 6) to provide for incremental vertical adjustment of pawl 94 relative to pawl support 86. A slotted aperture 100 in pawl 94, through which screw 96 is disposed, further facilitates the adjustment of pawl 94 relative to pawl support 86. As seen in FIG. 7, pawl 94 can be removed and reversed to accommodate for large door/gasket/frame dimensions, in which case the other tapped aperture 90 may be used to secure pawl 94 to pawl support 86.

Figure 5A:
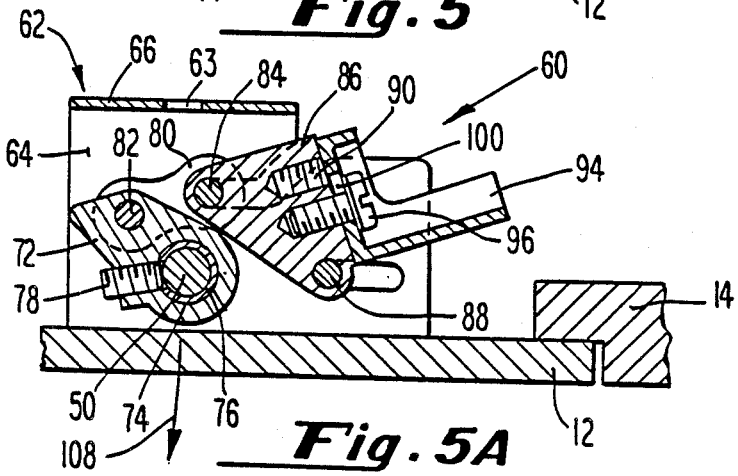
FIG. 5A is a sectional view, similar to FIG. 5, showing the latch assembly in the unlatched position.
Figure 6:
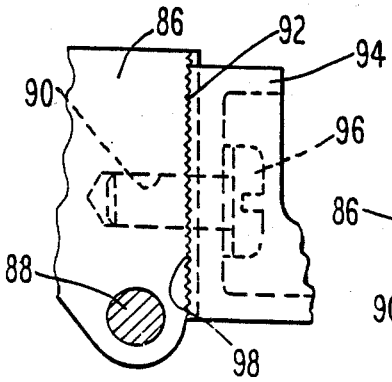
FIG. 6 is an enlarged, isolated view of the connection between the pawl and pawl support illustrating the adjustability feature of the pawl.

The operation of the present invention will now be fully described with particular reference to FIGS. 2, 5 and 5A. When the remote latching mechanism of the present invention is the latched or closed position, handle 32 is in the position shown in solid lines in FIG. 2 and pawl 94 is secured against frame 14, as seen in FIG. 5, whereby door 12 is held firmly closed. To open door 12, the fingers of the user are inserted into the space in cup 22 of handle assembly 20 to engage serrated surface 36 of handle 32. A simple lifting force is then exerted by the user, causing handle 32 to pivot, in the direction of arrow 101, into the open position illustrated in broken lines in FIG. 2.

Upon the pivoting of handle 32, connecting rod 50 will rotate counterclockwise about its longitudinal axis via its connection with handle 32 by set screw 43. The counterclockwise rotation of rod 50 will cause crank 72 to rotate counterclockwise in the direction of arrow 102, as seen in FIG. 5, via set screw 78 and sleeve 76. The rotation of crank 72, via pivot pin 82, will cause link members 80 to first pivot about transverse pin 84, and then to move leftwardly as crank 72 continues to rotate. It is during the initial pivoting movement of links 80 that transverse pin 82 crosses the on-center position between rod 50 and pin 84. The movement of pin 84 is guided by a pair of curved slots 104 in side walls 64 of housing 62. (See FIG. 4.)

Pawl support 86, being connected to link members 80 by pin 84, will undergo a sliding and pivoting motion as link members 80 and crank 72 are moved. The movement of pawl support 86 is guided by pins 84 and 88 being disposed in housing slots 104 and 106, respectively. The pivoting and sliding movement of pawl support 86 will likewise cause pawl 94 to undergo similar movements, due to the rigid connection between them. Thus, as seen in FIGS. 5 and 5A, pawl 94 will be pivoted in a counterclockwise direction and out of contact with frame 14. Pawl 94 will then be slid leftwardly so as to be partially retracted within housing 62. In this position, sufficient clearance is available between pawl 94 and frame 14 whereby door 22 can be opened in the direction of arrow 108 in FIG. 5A.

To again latch the door 12 against the frame 14, handle 32 is pivoted in the clockwise direction (as seen in FIG. 2) which will cause a clockwise rotation of connecting rod 50. The clockwise rotation of rod 50 will, in turn, cause a clockwise rotation of crank 72 which, through links 80 and pins 82,84, will cause pawl support 84 and pin 88 to slide to the right. When pin 88 reaches the end of slot 106, pawl support 86 and pawl 94 will pivot in the clockwise direction and pawl 94 will engage frame 14 to pull door 12 tightly against the frame. Further rotation of crank 72 will cause pin 82 to pass the on-center position and the pawl will be secured by positive over-center latching action.

The above description and the views depicted in the Figures are for purposes of illustration only and are not intended to be, and should not be construed as, limitations on the invention. In particular and without limitation, terms such as inside, outside, right, left, etc. and derivatives thereof have been used for purposes of clarity in describing the invention only and it is to be understood that particular orientations will depend upon the use of the invention in a particular circumstance. Moreover, certain modifications or alternatives may suggest themselves to those skilled in the art upon reading of this specification, all of which are intended to be within the spirit and scope of the present invention as defined in the appended claims.

What is claimed is:

1. A remote latching mechanism comprising:

(a) a longitudinal connecting member rotatably movable about a longitudinal axis thereof;

(b) actuator means for rotating said connecting member about its longitudinal axis;

(c) a latch assembly operably connected to said connecting member for movement between latched and unlatched conditions in response to rotational movement of said connecting member;

(d) wherein said actuator means comprises a handle disposed within a handle cup for pivotal movement relative thereto, said connecting member being fixedly mounted to said handle, whereby said connecting member is rotated about its longitudinal axis in response to pivotal movement of said handle;

(e) wherein said handle is journalled within said handle cup by a bushing means; and wherein said connecting member is disposed within said bushing means and is connected to said handle.

2. The remote latching mechanism of claim 1, wherein said bushing means comprises a pair of bushing members; and wherein said connecting member is disposed within said bushing members and is connected to said handle by a set screw.

3. The remote latching mechanism of claim 2, wherein said handle cup is provided with at least one abutment adapted to engage said handle to limit the pivotal movement of said handle.

4. The remote latching mechanism of claim 1, wherein said handle, when in a closed position, is substantially flush with an outer surface of said handle cup.

5. The remote latching mechanism of claim 1, wherein said handle cup is adapted for being inserted within an aperture in a closure member; and wherein said actuator means further comprises a bracket for retaining said handle cup within an aperture in a closure member.

6. The remote latching mechanism of claim 1, wherein said handle further comprises locking means for locking said handle in a closed position relative to said handle cup.

7. The remote latching mechanism of claim 1, wherein said actuator means comprises a socket member affixed to a terminal end of said connecting member, whereby said connecting member is rotatably movable in response to the application of torque to said socket member.

8. The remote latching mechanism of claim 1, wherein said connecting member comprises a cylindrical rod.

9. The remote latching mechanism of claim 1, wherein said latch assembly comprises:

(a) a housing;

(b) a crank disposed within said housing for limited rotational movement therein;

(c) at least one link member connected to said crank; and (d) pawl means connected to said at least one link member, (e) wherein said pawl means is selectively movable between latched and unlatched positions in response to rotational movement of said crank.

10. The remote latching mechanism of claim 9, wherein said crank is connected to said connecting member by a set screw, whereby said crank is rotatably movable in response to the rotational movement of said connecting member.

11. The remote latching mechanism of claim 9, wherein said housing further comprises flange means adapted for mounting said housing to a closure member.

12. The remote latching mechanism of claim 9, wherein said at least one link member is connected to said crank by a first transverse pin, whereby said at least one link member is pivotally movable relative to said crank.

13. The remote latching mechanism of claim 12, wherein said at least one link member is connected to said pawl means by a second transverse pin, said second transverse pin further engaging slotted apertures in opposing side walls of said housing, wherein said pawl means is pivotally and slidably movable in response to movement of said at least one link member, and wherein said second transverse pin and said slotted apertures comprise means for facilitating the sliding and pivoting movement of said pawl means in response to the rotation of said crank.

14. The remote latching mechanism of claim 13, further comprising a third transverse pin disposed through said pawl means and in engagement with additional slotted apertures in said opposing side walls of said housing, said third transverse pin and said additional slotted apertures comprising means for facilitating the pivoting and sliding of said pawl means.

15. The remote latching mechanism of claim 9, wherein said pawl means comprises a pawl and a pawl support, and wherein said pawl is adjustably mounted to said pawl support.

16. The remote latching mechanism of claim 15, wherein said pawl support is provided with serrations on a surface thereof; wherein said pawl is provided with serrations on a surface thereof; wherein the serrated surface of said pawl is in matable engagement with the serrated surface of said pawl support; and wherein said matable serrated surfaces comprise means for incrementally adjusting the position of said pawl relative to said pawl support.

17. The remote latching mechanism of claim 9, said at least one link member comprises an over-center member for securing said pawl in the latched position.

18. A remote latching mechanism comprising:

(a) a connecting member;

(b) actuator means for rotating said connecting member about a longitudinal axis thereof, said actuator means comprising:

(1) a handle cup adapted for being received within an aperture in a closure member;

(2) a handle journalled within said handle cup for pivotal movement between open and closed positions relative thereto;

(3) said handle being fixedly mounted to said connecting member for rotation of said connecting member in response to pivotal movement of said handle;

(4) a bracket for securing said handle cup within an aperture in a closure member;

(c) a latch assembly operably connected to said connecting member for movement between latched and unlatched conditions in response to rotational movement of said connecting member, said latch assembly comprising:

(1) a housing adapted for being affixed to a closure member;

(2) a crank affixed to said connecting member and disposed within said housing for limited rotational movement therein in response to rotational movement of said connecting member;

(3) at least one link member connected to said crank by a first transverse pin for pivoting and sliding movement in response to the rotation of said crank;

(4) a pawl support disposed within said housing and connected to said at least one link member by a second transverse pin, said second transverse pin being engaged with slotted apertures in said housing, said second transverse pin and said slotted apertures comprising means for facilitating pivoting and sliding movement of said pawl support in response to movement of said at least one link member;

(5) a third transverse pin disposed through said pawl support and in engagement with additional slotted apertures in said housing, said third transverse pin and said additional slotted apertures comprising means for facilitating the sliding and pivoting of said pawl support;

(6) said pawl support having a serrated surface thereon;

(7) a pawl adjustably connected to said serrated surface of said pawl support for selective adjustment of said pawl relative to said pawl support;

(8) said pawl having a serrated surface in matable engagement with said serrated surface of said pawl support, said serrated surfaces comprising means for incrementally adjusting said pawl relative to said pawl support;

(9) said pawl being selectively movable between latched and unlatched positions in response to the sliding and pivoting of said pawl support; and (d) wherein said at least one link member comprises an over-center member for securing said pawl in the latched position.

19. The remote latching mechanism of claim 18, further comprising supplemental actuator means, said supplemental actuator means comprising a socket member affixed to a terminal end of said connecting member, whereby said connecting member is rotatably movable in response to the application of torque to said socket member.

20. The remote latching mechanism of claim 18, wherein said connecting means comprises a cylindrical rod.

21. The remote latching mechanism of claim 18, wherein said actuator means further comprises a locking means disposed within said handle for locking said handle in said closed position relative to said handle cup.

22. The remote latching mechanism of claim 18, wherein said pawl is connected to said pawl support by a threaded fastener and wherein said serrated surface of said pawl support is provided with at least one tapped aperture for said threaded fastener.

23. A remote latching mechanism comprising:

(a) a longitudinal connecting member rotatably movable about a longitudinal axis thereof;

(b) actuator means for rotating said connecting member about its longitudinal axis; and (c) a latch assembly operably connected to said connecting member for movement between latched and unlatched conditions in response to rotational movement of said connecting member;

(d) wherein said latch assembly comprises:

(1) a housing;

(2) a crank disposed within said housing and affixed to said connecting member whereby said crank is rotatably movable in response to rotation of said connecting member;

(3) at least one link member connected to said crank; and (4) pawl means connected to said at least one link member wherein said pawl means is selectively movable between latched and unlatched positions in response to rotational movement of said crank.

24. The remote latching mechanism of claim 23, wherein said actuator means comprises a handle disposed within a handle cup for pivotal movement relative thereto, said connecting member being fixedly mounted to said handle, whereby said connecting member is rotated about its longitudinal axis in response to pivotal movement of said handle.

25. The remote latching mechanism of claim 24, wherein said handle is journalled within said handle cup by a pair of bushing members; and wherein said connecting member is disposed within said bushing members and is connected to said handle by a set screw.

26. The remote latching mechanism of claim 25, wherein said handle cup is provided with at least one abutment adapted to engage said handle to limit the pivotal movement of said handle.

27. The remote latching mechanism of claim 24, wherein said handle, when in a closed position, is substantially flush with an outer surface of said handle cup.

28. The remote latching mechanism of claim 24, wherein said handle cup is adapted for being inserted within an aperture in a closure member; and wherein said actuator means further comprises a bracket for retaining said handle cup within an aperture in a closure member.

29. The remote latching mechanism of claim 24, wherein said handle further comprises locking means for locking said handle in a closed position relative to said handle cup.

30. The remote latching mechanism of claim 23, wherein said actuator means comprises a socket member affixed to a terminal end of said connecting member, whereby said connecting member is rotatably movable in response to the application of torque to said socket member.

31. The remote latching mechanism of claim 23, wherein said connecting member comprises a cylindrical rod.

32. The remote latching mechanism of claim 23, wherein said housing further comprises flange means adapted for mounting said housing to a closure member.

33. The remote latching mechanism of claim 23, wherein said at least one link member is connected to said crank by a first transverse pin, whereby said at least one link member is pivotally movable relative to said crank.

34. The remote latching mechanism of claim 33, wherein said at least one link member is connected to said pawl means by a second transverse pin, said second transverse pin further engaging slotted apertures in opposing side walls of said housing, wherein said pawl means is pivotally and slidably movable in response to the movement of said at least one link member, and wherein said second transverse pin and said slotted apertures comprise means for facilitating the sliding and pivoting movement of said pawl means in response to the rotation of said crank.

35. The remote latching mechanism of claim 34, further comprising a third transverse pin disposed through said pawl means and in engagement with additional slotted apertures in said opposing side walls of said housing, said third transverse pin and said additional slotted apertures comprising means for facilitating the pivoting and sliding of said pawl means.

36. The remote latching mechanism of claim 23, wherein said pawl means comprises a pawl and a pawl support and wherein said pawl is adjustably mounted to said pawl support.

37. The remote latching mechanism of claim 36, wherein said pawl support is provided with serrations on a surface thereof; wherein said pawl is provided with serrations on a surface thereof; wherein the serrated surface of said pawl is in matable engagement with the serrated surface of said pawl support; and wherein said matable serrated surfaces comprise means for incrementally adjusting the position of said pawl relative to said pawl support.

38. The remote latching mechanism of claim 23, wherein said at least one link member comprises an over-center member for securing said pawl in the latched position.

* * * * *